US008613164B1

(12) United States Patent
Barber

(10) Patent No.: US 8,613,164 B1
(45) Date of Patent: Dec. 24, 2013

(54) HIDE-AWAY CLOSET DOOR HARDWARE

(76) Inventor: David Barber, Denver, CO (US)

( * ) Notice: Subject to any disclaimer, the term of this patent is extended or adjusted under 35 U.S.C. 154(b) by 0 days.

(21) Appl. No.: 13/347,608

(22) Filed: Jan. 10, 2012

Related U.S. Application Data

(60) Provisional application No. 61/460,959, filed on Jan. 11, 2011.

(51) Int. Cl.
*E06B 3/32* (2006.01)
*E06B 9/58* (2006.01)

(52) U.S. Cl.
USPC ..... 52/29; 52/64; 52/243.1; 49/209; 49/409; 312/222

(58) Field of Classification Search
USPC ..... 52/27.5, 29, 32, 64, 207, 204.51, 243.1; 49/209, 213, 409, 410; 312/138.1, 312/139.1, 307, 322, 323, 334.25, 334.26
See application file for complete search history.

(56) References Cited

U.S. PATENT DOCUMENTS

| | | | | | |
|---|---|---|---|---|---|
| 1,008,266 | A | * | 11/1911 | Hofman et al. | 312/139.1 |
| 1,678,453 | A | * | 7/1928 | Welch | 312/139.1 |
| 3,334,375 | A | * | 8/1967 | Eugene | 16/97 |
| 3,494,407 | A | * | 2/1970 | Bedrin et al. | 160/199 |
| 3,984,930 | A | * | 10/1976 | Booland | 40/491 |
| 3,990,183 | A | * | 11/1976 | Meggs et al. | 49/125 |
| 4,388,778 | A | * | 6/1983 | Brooke | 49/125 |
| 4,569,164 | A | * | 2/1986 | Dickson | 52/64 |
| 5,022,454 | A | * | 6/1991 | Kobayashi et al. | 160/202 |
| 5,083,847 | A | * | 1/1992 | Peters | 312/322 |
| 5,088,236 | A | * | 2/1992 | Karhu | 49/127 |
| 5,090,171 | A | * | 2/1992 | Kano et al. | 52/243.1 |

FOREIGN PATENT DOCUMENTS

EP 0 457 286 A1 * 11/1991

* cited by examiner

*Primary Examiner* — Robert Canfield
(74) *Attorney, Agent, or Firm* — Ramon L. Pizarro; Edwin H. Crabtree

(57) ABSTRACT

A closet door support mechanism that provides rotation and translation of a door used to close the entry to a room such as a closet is disclosed. An example of the mechanism includes a first track that is generally straight and is connected to a first track retraction section by a curved section. The track sections are mounted a distance from the floor, and allow movement of a closet door through translation and rotation to close the entry of the closet.

1 Claim, 4 Drawing Sheets

HIDE-AWAY CLOSET DOOR HARDWARE

REFERENCE TO RELATED APPLICATIONS

This application claims the benefit of my U.S. provisional application titled HIDE-AWAY CLOSET DOOR HARDWARE, having Ser. No. 61/460,959, filed Jan. 11, 2011.

BACKGROUND OF THE INVENTION (a) Field of the Invention

This invention generally relates to a system for mounting and allowing opening and closing of doors for doors for small enclosures, such as closet. More particularly, but not by way of limitation, the invention relates to a system and method for providing sliding opening and closing for a door for closets and similar spaces in a building.

(b) Discussion of Known Art

Track-mounted closet doors have been used for solving problems associated with closing off small spaces, such as closets and laundry areas. However, these devices typically depend on multi-hinged folding doors or flexible doors. These approaches suffer from the shortcomings associates with multiple hinged panels, which typically cannot be completely concealed when opened, or provide multiple failure locations through the use of multiple hinges or flexing axes. Often in situations where doors are needed to close off smaller spaces that are positioned next to one another, the only solution is to place some sort of collapsing door, such as a set of panel doors mounted on a track, or use a curtain or similar device, or to use swinging doors that consume a great amount of space when opened into a hallway, for example.

Accordingly, there remains a need for a closet door arrangement that fit within small spaces or rooms without taking up a significant amount of space within the closet, without the use of multiple hinges or flexing panels, and without hindering passageways when opened.

SUMMARY

It has been discovered that the problems left unanswered by known art can be solved by providing a closet door support mechanism that supports a rigid, planar, door having an upper edge, the closet door support mechanism door between a horizontal floor and an upper wall, and includes:

a first track having a first track closure section and a first track retraction section, the first track closure section being generally straight and connected to the first track retraction section by a curved section, the first track retraction section being generally straight, the first track closure section being generally straight and at an angle, preferably a ninety degree angle, to the first track retraction section, the first track closure section being adapted for mounting at a distance from the floor;

a second track that is generally parallel to the first track retraction section and is adapted for being supported at about the same distance from the floor as the first track closure section;

a rigid first support, the rigid first support having a first support door mounting area and a first support roller mounting area, the first support roller mounting area being next to the first support door mounting area, the first support having a first support roller that is adapted for engaging and rolling along the first track is mounted from the first support roller mounting area, the first support roller being mounted at a distance from the first support door mounting area, the first support door mounting area being adapted for attachment to the upper edge of the door, so that the first support roller is next to the plane of the door when the first support door mounting area is attached to the upper edge of the door;

a rigid second support, the rigid second support having a second support door mounting area and a second support roller mounting area, the second support roller mounting area being coincident with or below the second support door mounting area, the second rigid support having a second support roller that is adapted for engaging and rolling along the second track and that is mounted from the second support roller mounting area, the second support door mounting area being adapted for attachment to the upper edge of the door while the second support roller is along the plane of the door when the second support door mounting area is attached to the upper edge of the door, so that movement of the first roller between the first track closure section and the first track retraction section causes the second support roller to travel along the second track, so that a door mounted from the first support and the second support moves from a first position where the door closes the entry of the closet to a second position were the door is at about ninety degrees from the first position.

It is further contemplated that a strut support track and a strut member that is adapted for movement along the strut support track may be added to the system. The strut support track would be adapted for mounting at about the same distance from the floor as the first track closure section or the second track. The strut member would be used to limit rotation of a door mounted from the system. The rotation to be limited being rotation about an axis that extends between the first support and the second support. In other words, the strut member would serve to stabilize the door in a vertical position in order to prevent the door from swinging into or out of the space being closed off by the door.

Still further, it is contemplated that the disclosed system may include floor rollers that would further support the door used with the disclosed system. These rollers would be mounted from a lower edge of the door and would preferably be mounted directly below the first support roller and the second support roller.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
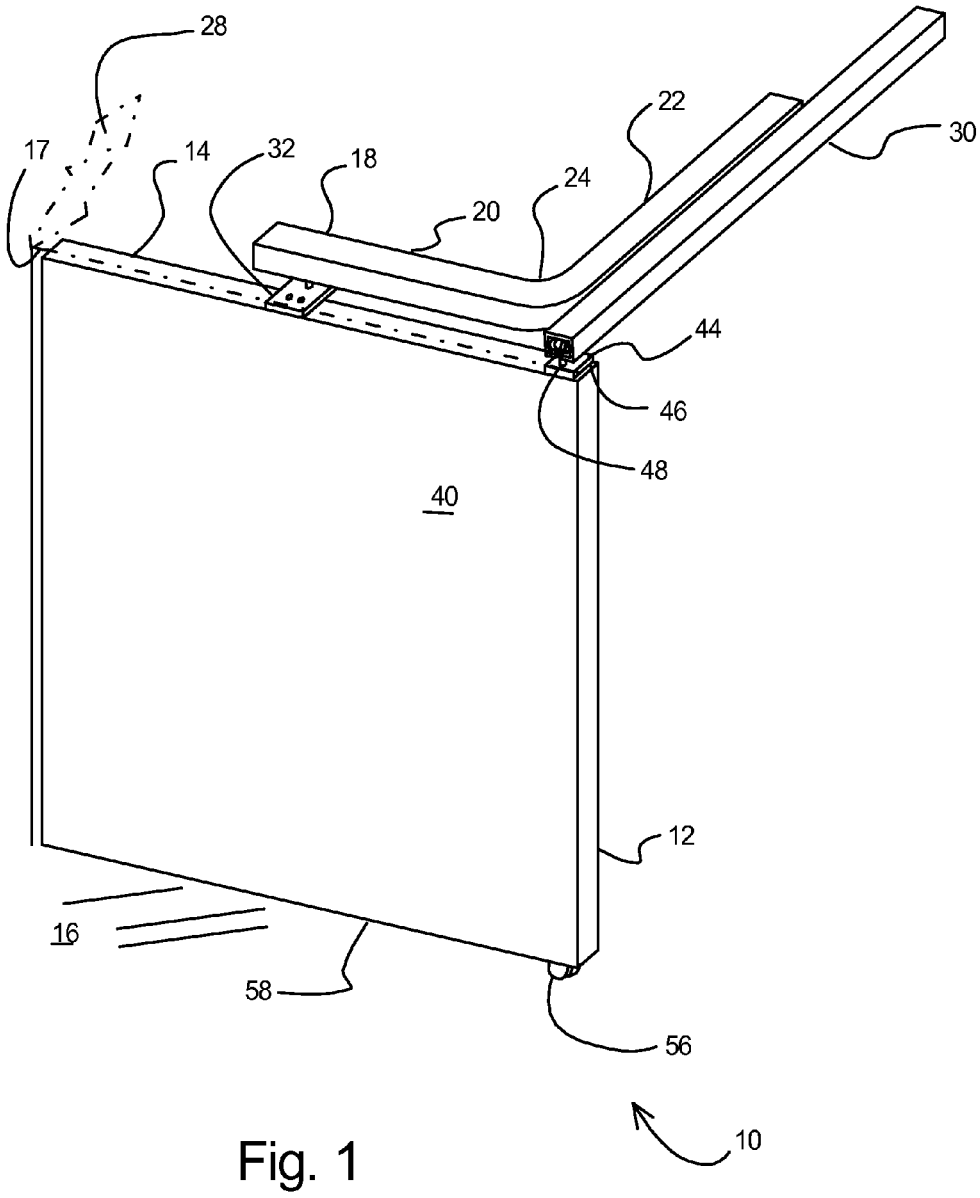
FIG. 1 is a perspective view of an embodiment of the invention in use while supporting a door to close an entrance.

Attention is directed now to FIG. 1 where a closet door support system 10 that is adapted for supporting a rigid, planar, door 12 and incorporating inventive principles taught here have been illustrated. The door 12 used with the support system 10 has been illustrated as having an upper edge 14 that when in use will be next to the support system 10. It will be understood that the closet door support system 10 supports the door 12 between a horizontal floor 16 and an upper wall 17, which may be part of a ceiling or similar boundary surface.

Figure 6:
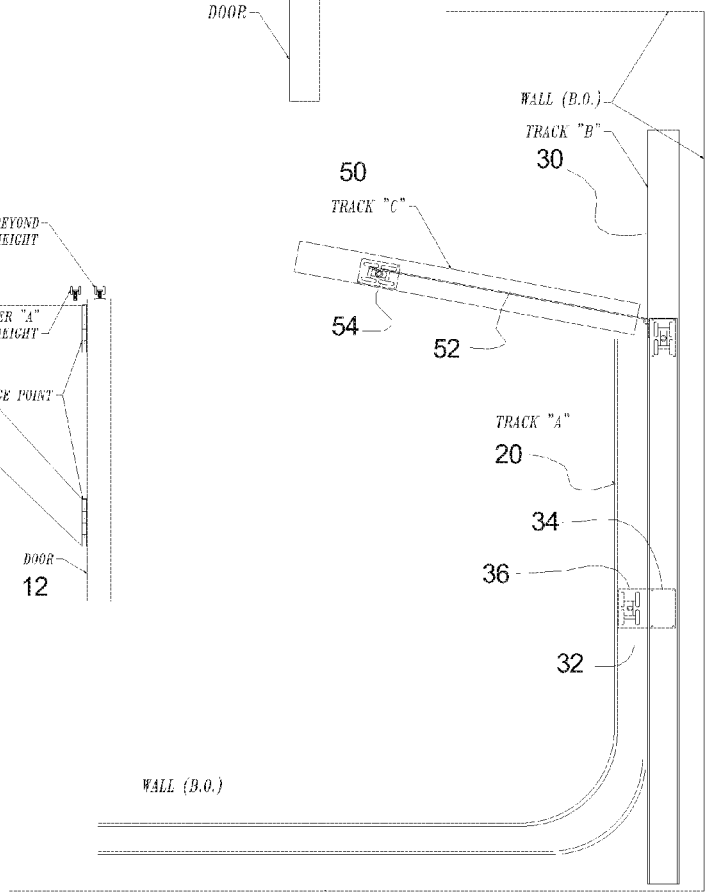
FIG. 6 is a detailed plan view of a highly preferred embodiment of the invention that also includes the use of a strut track, and illustrates the positioning of rollers along the strut track when the door is in an opened position.

FIG. 1, as well as FIG. 6, illustrate that the disclosed system includes a first track 18 that include a first track closure section 20 and a first track retraction section 22. As illustrated, the first track closure section 20 and the first track retraction section 22 are generally straight. The first track closure section 20 is connected to the first track retraction section 22 by a curved section 24 that connects the two sections at an angle 26, which is preferably a ninety-degree angle. The first track closure section 20 and the first track retraction section 22 are to be mounted from a ceiling or upper support structure 28, such as at least a portion of the upper wall 17. The upper support structure would retain the first track closure section 20 and the first track retraction section 22 at a distance from the floor 16.

FIG. 1 also illustrates that a second track 30, that is generally parallel to the first track retraction section 22 is also used with the disclosed system. The second track 30 is adapted for being supported at about the same distance from the floor 16 as the first track closure section 20. Preferably, the first track closure section 20 and the first track retraction section 22 are supported in a generally horizontal and generally co-planar fashion from the floor 16.

FIGS. 1, and 3-6 illustrate that a rigid first support 32 is used as part of the structure that holds the upper edge 14 of the door 12 to the first track 18. The rigid first support 32 includes a first support door mounting area 34 and a first support roller mounting area 36. The first support roller mounting area 36 will be positioned next to the first support door mounting area 34. Additionally, the rigid first support 32 will include or retain a first support roller 38 that is adapted for engaging and rolling along the first track 18.

FIGS. 3-6 show the first support roller 38 as being mounted from the first support roller mounting area, the first support roller being mounted at a distance from the first support door mounting area 34, and illustrate that the first support door mounting area is also adapted for attachment to the upper edge 14 of the door 12, so that the first support roller 38 is next to the plane 40 of the door 12 when the first support door mounting area is attached to the upper edge of the door 12. That is, the first support roller 38 will be at a distance from the plane of the door 12.

A second support cooperates with the rigid first support 32 to support the door 12 from the tracks of the system 10. Accordingly, FIGS. 1-6 illustrate the use of a rigid second support 44 to support the door from the second track 30. The rigid second support 44 includes a second support door mounting area 46 and a second support roller mounting area 48. The second support roller mounting area 48 has been adapted for being coincident with or below the second support door mounting area 46, such that the door 12 will be supported directly below a second support roller 50 that will be used for engaging and rolling along the second track 30.

Accordingly, the second support roller 50 will be mounted from the second support roller mounting area 48, and the second support door mounting area 48 is also used for attachment to the upper edge 14 of the door 12. This will place the second support roller 50 along the plane 40 of the door 12 when the second support door mounting area 48 is attached to the upper edge 14 of the door 12.

Figure 3:
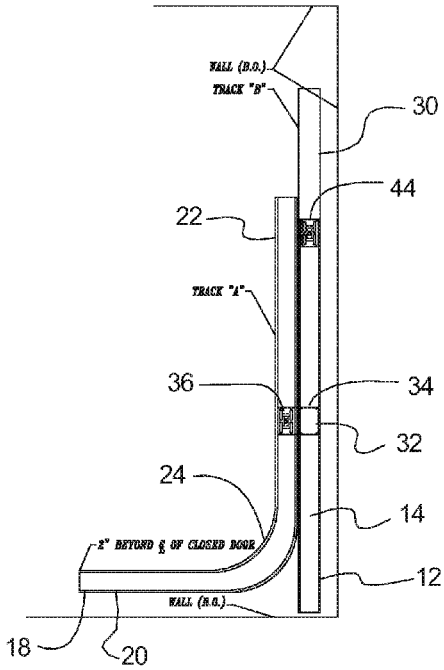
FIG. 3 is a detailed plan view of a highly preferred embodiment of the invention.

When the door 12 is attached to the disclosed system 10, movement of the first support roller 38 between the first track closure section 20 and the first track retraction section 22 causes the second support roller 50 to travel along the second track 30, so that a door 12 mounted from the first support 32 and the second support 44 moves from a first position, illustrated in FIG. 1, where the door closes the entry of the closet to a second position, illustrated in FIG. 3, where the door is at about ninety degrees from the first position.

Figure 2:
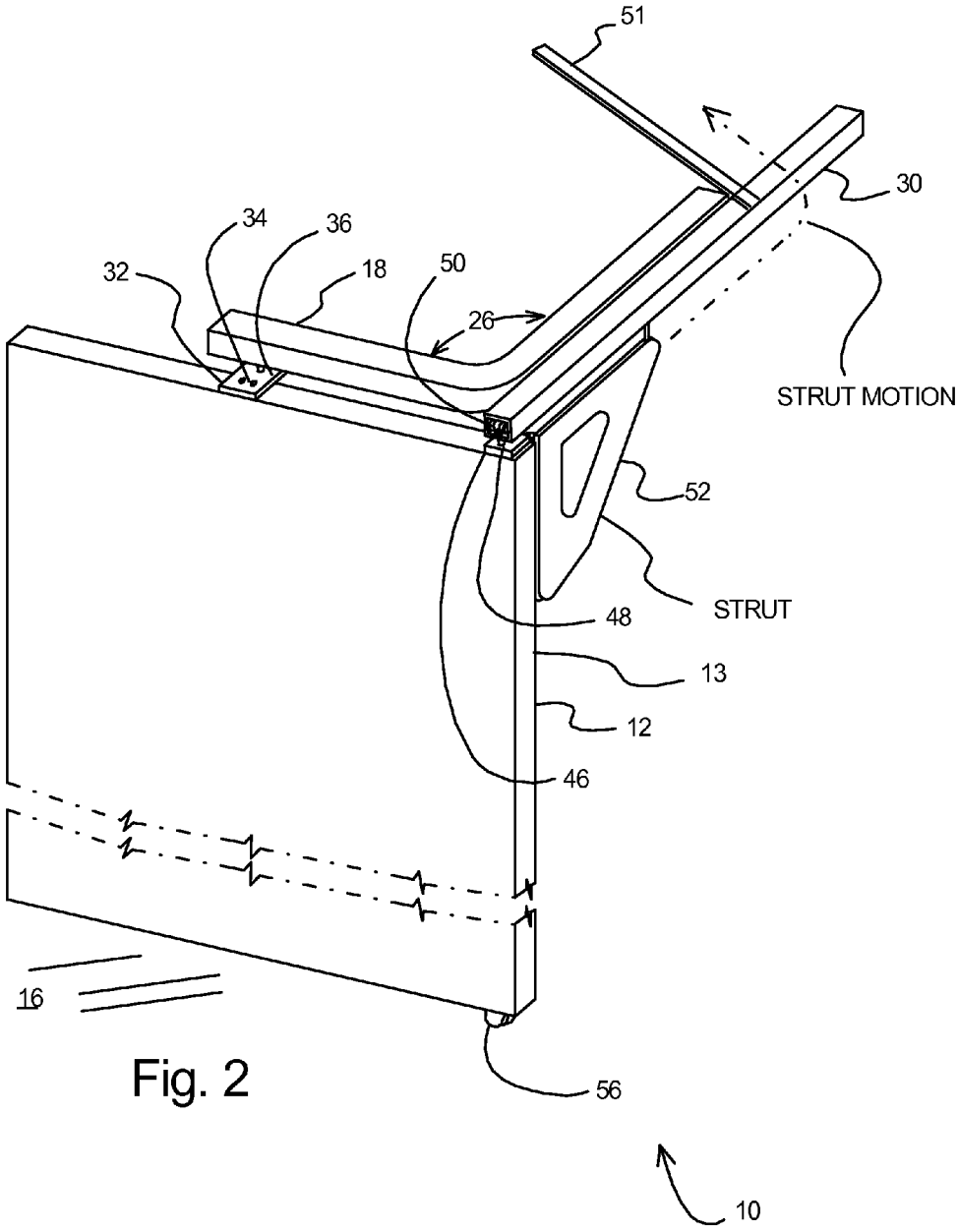
FIG. 2 is a perspective view of an embodiment of the invention with the use of a strut member in use while supporting a door to close an entrance, and further illustrates the use the strut support track.
Figure 7:
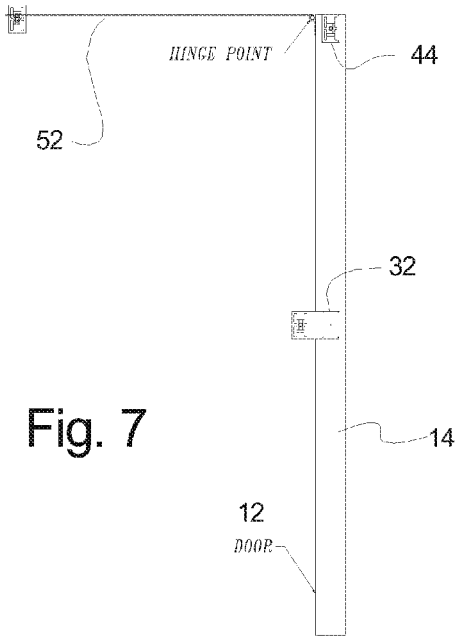
FIG. 7 is a detailed plan view of a door used with the arrangement illustrated in FIG. 6, and illustrates the attachment of the rigid first support and the rigid second support.
Figure 8:
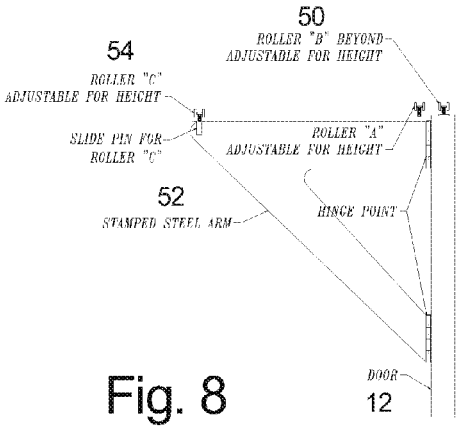
FIG. 8 is a detailed elevation of a door used with the arrangement illustrated in FIG. 6, and illustrates the attachment of the strut to the door.

Turning now to FIGS. 2 and 6-8 it will be understood that it is further contemplated that a strut support track 51 and a strut member 52 will extend from a vertical portion 13 of the door 12 and be used to stabilize the door 12, keeping the door from swinging about the tracks used with the support rollers. Thus, the strut member 52 would be used to limit rotation of a door mounted from the system. The strut support track 51 would be mounted at about the same distance from the floor 16 as the first track 18 and the second track 30, meaning that it is contemplated that the strut support track 50 will be supported along the same plane as the first track 18 and the second track 30. As illustrated in FIGS. 2 and 6, the strut support track 51 is mounted at an angle to the second track 30 such that the strut support track 51 is at an obtuse angle to the second track 30. This arrangement facilitates the movement of the strut member 52 along the strut support track 50 as the door 12 is moved between the open and closed positions. FIGS. 7 and 8 illustrate that it is contemplated that at least one strut roller 54 will be connected the strut member 52 from the strut support track 51. This will allow the strut member 52 to stabilize the door 12 through the strut member's hinged connection to the door 12.

Figure 4:
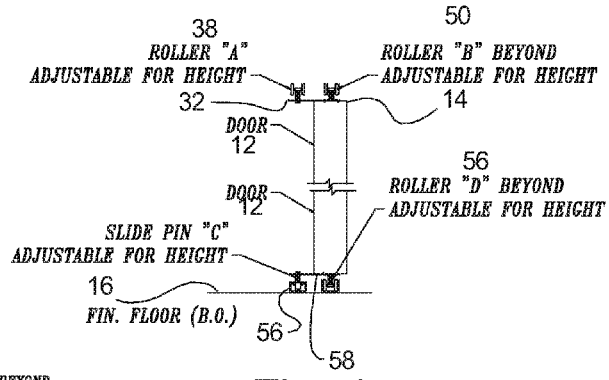
FIG. 4 is a detailed elevation of a highly preferred arrangement of a door that has been adapted for use with the disclosed system, and illustrates the attachment of the rigid first support and the rigid second support as well as the use of floor rollers.
Figure 5:
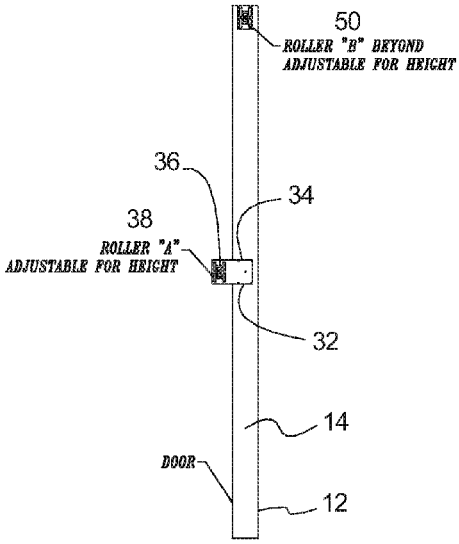
FIG. 5 is a detailed plan view of a door that has been adapted for use with the disclosed system, and illustrates the attachment of the rigid first support and the rigid second support.

Still further, as illustrated in FIG. 4, in a highly preferred embodiment of the invention, it is contemplated that the disclosed system may include floor rollers 56 that would further support the door 12 used with the disclosed system. It is contemplated that the floor rollers 56 would be mounted from a lower edge 58 of the door 12. The floor rollers would keep the door 12 from swinging into the closet space when the door 12 is in the closed position. Similarly, additional floor rollers 56 may also be used along the lower edge 58, below the second support 44, to further stabilize the door.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A closet door support mechanism that supports a rigid, planar, door having an upper edge, the closet door support mechanism door between a horizontal floor and an upper wall, and includes:

a first track having a first track closure section and a first track retraction section, the first track closure section being generally straight and connected to the first track retraction section by a curved section, the first track retraction section being generally straight, the first track closure section being generally straight and at an angle to the first track retraction section, the first track closure section being adapted for mounting at a distance from the floor;

a second track that is generally parallel to the first track retraction section and is configured for being supported at about the same distance from the floor as the first track closure section;

a rigid first support, the rigid first support having a first support door mounting area and a first support roller mounting area, the first support roller mounting area being next to the first support door mounting area, the first support having a first support roller that is adapted for engaging and rolling along the first track the first support door mounting area being adapted for attachment to the upper edge of the door, so that the first support roller is next to the plane of the door when the first support door mounting area is attached to the upper edge of the door;

a rigid second support, the rigid second support having a second support door mounting area and a second support roller mounting area, the second support roller mounting area being directly below the second support door mounting area, the rigid second support having a second support roller that is configured for engaging and rolling along the second track, the second support door mounting area being adapted for attachment to the upper edge of the door while the second support roller is along the plane of the door when the second support door mounting area is attached to the upper edge of the door;

a strut support track, the strut support track extending from the second track such that the strut support track and the first track having a first track closure section are on one side of the second track; and a strut member, the strut member extending from a vertical portion of the door and to the strut support track, so that the strut member will move along the second track and along strut support track when the door is moved along the track closure section, and so that the strut member will retain the door in a vertical position; and so that movement of the first roller between the first track closure section and the first track retraction section causes the second support roller to travel along the second track, so that a door mounted from the first support and the second support moves from a first position where the door closes the entry of the closet to a second position were the door is at about ninety degrees from the first position.

* * * * *